US005680682A

United States Patent [19]

Watkins et al.

[11] Patent Number: 5,680,682

[45] Date of Patent: Oct. 28, 1997

[54] CASKET

[76] Inventors: Lyle Watkins; Daniel Watkins, both of 4805 Fort Hamer Rd., Parrish, Fla. 34216

[21] Appl. No.: 614,663

[22] Filed: Mar. 13, 1996

[51] Int. Cl.[6] ..... A61G 17/00

[52] U.S. Cl. ..... 27/7; 27/14

[58] Field of Search ..... 27/2, 6, 7, 14, 27/16, 17, 19, 35

[56] References Cited

U.S. PATENT DOCUMENTS

| | | | |
|---|---|---|---|
| 1,837,249 | 12/1931 | Barber | 27/35 |
| 2,508,319 | 5/1950 | Westenhaer | 27/35 |
| 3,164,880 | 1/1965 | Hotchkiss . | |
| 3,172,183 | 3/1965 | Bugg | 27/35 |
| 3,295,179 | 1/1967 | Behrendt | 27/35 |
| 3,545,055 | 12/1970 | Pare . | |
| 3,681,820 | 8/1972 | Jalbert . | |
| 3,918,133 | 11/1975 | Schmitz . | |
| 4,034,447 | 7/1977 | Kollmann et al. . | |
| 4,101,617 | 7/1978 | Friederich . | |
| 4,174,556 | 11/1979 | Richings . | |
| 4,253,220 | 3/1981 | Work . | |
| 4,267,623 | 5/1981 | Christian . | |
| 4,315,353 | 2/1982 | Sorensen . | |
| 4,320,562 | 3/1982 | Kelley . | |
| 4,890,366 | 1/1990 | Schaapveld . | |
| 4,948,547 | 8/1990 | Hendry . | |
| 5,015,166 | 5/1991 | Baxi . | |
| 5,069,859 | 12/1991 | Loren . | |
| 5,088,167 | 2/1992 | Rahe | 27/1 |
| 5,121,529 | 6/1992 | McClure . | |
| 5,222,281 | 6/1993 | Guérin . | |
| 5,301,398 | 4/1994 | Bursey, Jr. . | |

*Primary Examiner*—Kien T. Nguyen
*Attorney, Agent, or Firm*—Charles J. Prescott

[57] ABSTRACT

A casket having a tub, lid and pedestal base each separately molded of plastic material. The tub is integrally molded of plastic as a single unit having an endless hollow peripheral side wall formed by fluid injection, the tub having curved inner and outer surfaces. The pedestal base is also integrally molded of plastic as a single unit having an endless hollow perimeter formed by fluid injection, the base having a curved upper molded surface which supportively engages with a curved bottom surface of said tub. Self aligning and locking structure for properly aligning and connecting said tub within said pedestal base is integrally molded into corresponding mating surfaces. The lid is similarly integrally molded of plastic as a single unit having an endless hollow peripheral side wall formed by fluid injection, the lid having continuous curved upper and lower surfaces. The tub and lid are hinge connected together after molding along a common longitudinal side margin therebetween. A hermetic seal between the lid and the tub for hermetically sealing the interior of the casket when closed is also provided, along with a self-locking device for permanently automatically locking the tub and the lid together when closed.

13 Claims, 7 Drawing Sheets

FIG. 9
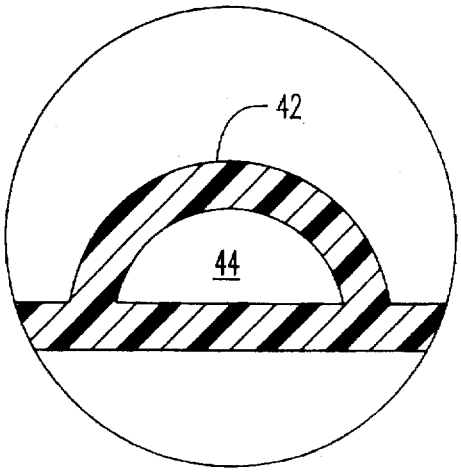
FIG. 10
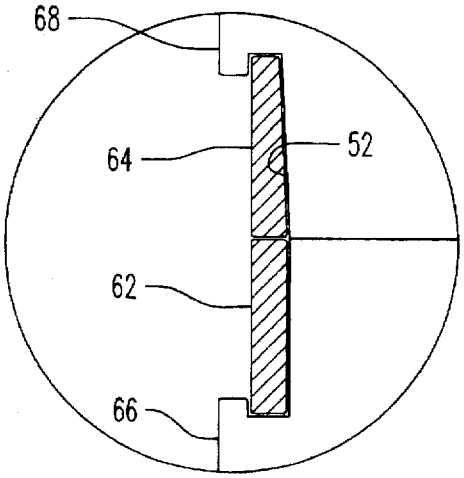
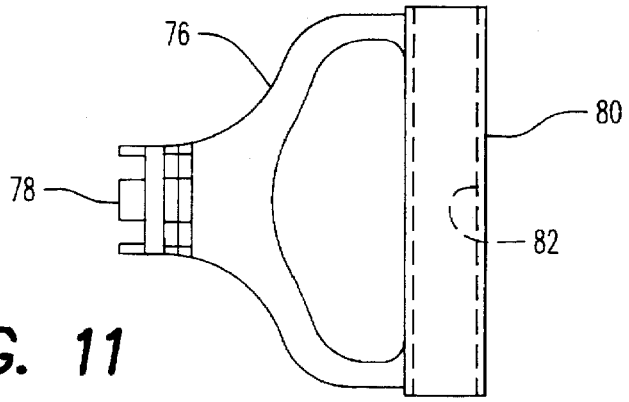
FIG. 11
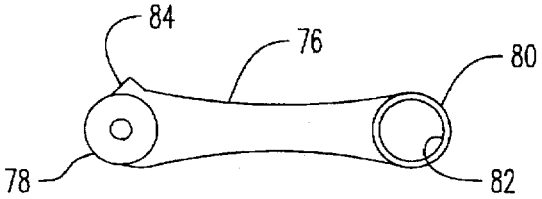
FIG. 12

FIG. 13
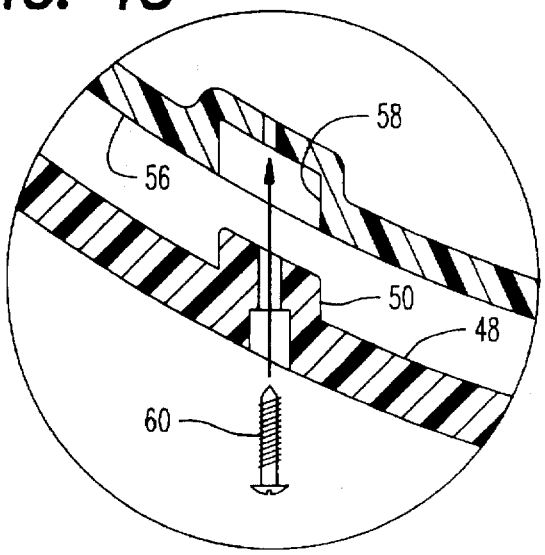
FIG. 16
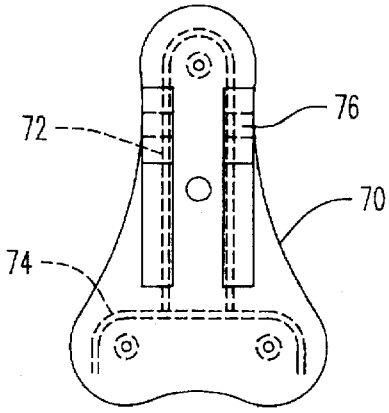
FIG. 17
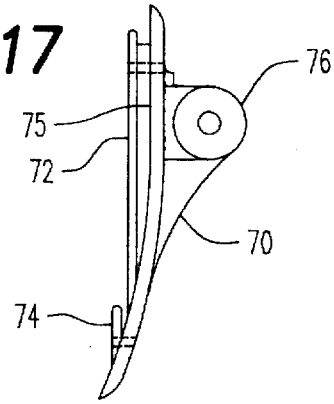
FIG. 14
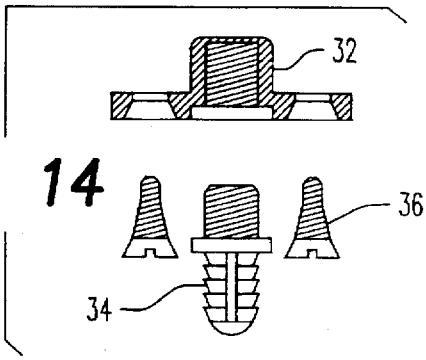
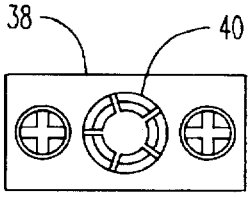
FIG. 15
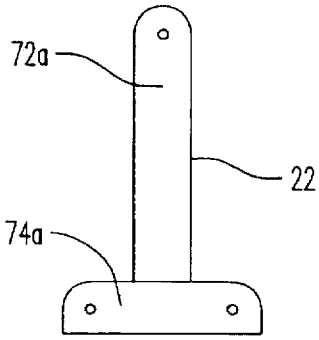
FIG. 18

CASKET

BACKGROUND OF THE INVENTION

1. Scope of Invention

This invention relates generally to burial vaults, and more particularly to a casket having separate integrally molded plastic components which utilize gas injection for strength and economy of manufacture and assembly.

2. Prior Art

Caskets which are fabricated of fiberglass or plastic are well known. The following U.S. Patents and their corresponding inventors for such caskets and burial vaults are as follows:

| | |
|---|---|
| 3,545,055 | Pare |
| 4,174,556 | Richings |
| 4,320,562 | Kelley |
| 5,121,529 | McClure |
| 5,301,398 | Bursey, Jr. |
| 3,164,880 | Hotchkiss |
| 5,222,281 | Guerin |

Other U.S. patents which teach various forms of burial vaults and caskets but are less similar to the present invention are as follows:

| | |
|---|---|
| 4,253,220 | Work |
| 4,315,353 | Sorensen |
| 3,681,820 | Jalbert |
| 3,918,133 | Schmitz |
| 4,890,366 | Schaapveld |
| 4,267,623 | Christian |
| 4,034,447 | Kollmann et al. |

The '281 Patent to Guerin teaches a molded coffin made of layers of hardened plasticize fiber mat and end-grain balsa core panels. Hotchkiss, in the '880 patent also teaches a plastic casket having a core of foam plastic between the inner and outer surfaces of both the tub and lid portion. Bursey, in the '398 patent, discloses a plastic cadaver container fabricated of flat plastic panels having a foam core for structural integrity. In the '529 patent, McClure teaches a casket made of thermoplastic material formed by either vacuum forming or injection molding as two longitudinal half shells which are joined together at the parting line to form a leak proof, integral shell.

A nestable casket invented by Kelly in the above-referenced '562 patent teaches a three piece molded tub head and foot lid sections for selective viewability. The casket taught by Richings in the '556 patent also teaches synthetic resin construction, the casket having a removable top cover that selectively encloses a body supporting bed. Pare, in the '055 patent, teaches a coffin molded of separate molded elements assembled by cementing or gluing and characterized by a perfect sealing of the cover and integrally folded formed handles.

None of the above patents teach the utilization of a separate connectable pedestal base beneath the tub or the utilization of gas or fluid injection into the molten plastic during molding so as to form structural cavities or hollow portions integrally with each of the three individually molded components of the present invention. Gas and other fluid injection into molten plastic during molding is taught, inter alia, in the following U.S. Patents:

| | |
|---|---|
| 5,069,859 | Loren |
| 4,948,547 | Hendry |
| 5,015,166 | Baxi |
| 4,101,617 | Friederich |

Although techniques of gas or fluid injection into molten plastic during molding operations are thus well known, nonetheless these techniques have not been used in conjunction with the massive size of a casket tub, its lid or pedestal for strength, manufacturing and assembly economy and reinforcement, while also providing a perfectly hermetically sealed casket when interred.

BRIEF SUMMARY OF THE INVENTION

This invention is directed to a casket having a tub, lid and pedestal base each separately molded of plastic material. The tub is integrally molded of plastic as a single unit having an endless hollow peripheral side wall formed by fluid injection, the tub having curved inner and outer surfaces. The pedestal base is also integrally molded of plastic as a single unit having an endless hollow perimeter formed by fluid injection, the base having a curved upper molded surface which supportively engages with a curved bottom surface of said tub. Self aligning and locking structure for properly aligning and connecting said tub within said pedestal base is integrally molded into corresponding mating surfaces. The lid is similarly integrally molded of plastic as a single unit having an endless hollow peripheral side wall formed by fluid injection, the lid having continuous curved upper and lower surfaces. The tub and lid are hinge connected together after molding along a common longitudinal side margin therebetween. A hermetic seal between the lid and the tub for hermetically sealing the interior of the casket when closed is also provided, along with a self-locking device for permanently automatically locking the tub and the lid together when closed.

It is therefore an object of this invention to provide a casket having molded individual components molded of plastic, each being molded as a unit utilizing gas or fluid injection strategically for added structural integrity, economy, and long-life durability after internment.

It is yet another object of this invention to provide a casket which utilizes a single die for each of the major components of tub, lid and pedestal base and the addition of gas or fluid injection into the molten plastic to form hollow perimeters in each component during molding of these three units.

It is yet another object of this invention to provide a casket having individual components which require no gluing, wood, or bonding agents in conjunction with the manufacture or assembly of each component or the entire casket.

It is yet another object of this invention to provide a casket which may be manufactured using a broad range of plastic materials, the primary characteristic being that of a thermal-plastic material.

It is still another object of this invention to provide a casket having individually molded components which are ready for assembly directly after molding and which provide a hermetically sealed long-life casket after interment.

In accordance with these and other objects which will become apparent hereinafter, the instant invention will now be described with reference to the accompanying drawings.

BRIEF DESCRIPTION OF THE DRAWINGS

FIG. 9 is an enlarged section view of a typical hollow strengthening rib formed by fluid injection during mold operation.

FIG. 10 is a further enlarged section view of a portion of FIG. 7.

FIG. 11 is a top plan view of one embodiment of a removable carrying handle.

FIG. 12 is an end elevation view of FIG. 11.

FIG. 13 is an enlarged view of the alignment and locking means provided between the tub and the pedestal base.

FIG. 14 is an enlarged section view of the lid locking member.

FIG. 15 is a plan view of the latch plate which mateably engages with the locking member of FIG. 14 when the lid is in a closed position.

FIG. 16 is an elevation view of an intermediate handle mounting bracket.

FIG. 17 is an end view of FIG. 16.

FIG. 18 is an enlarged view of one handle receiver molded into the sides of the tub.

DETAILED DESCRIPTION OF THE INVENTION

Figure 1:
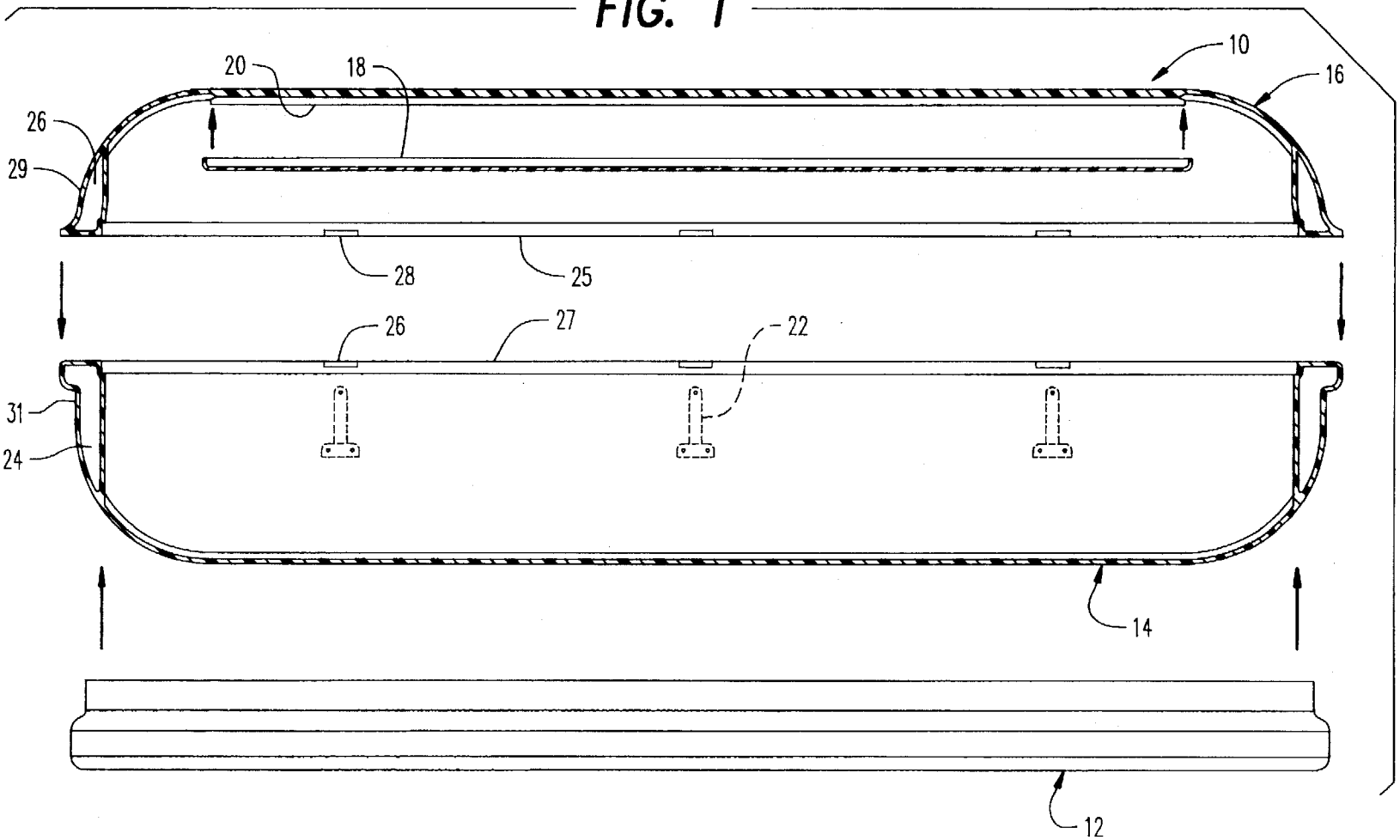
FIG. 1 is an exploded side elevation view of all main molded components of the invention.
Figure 2:
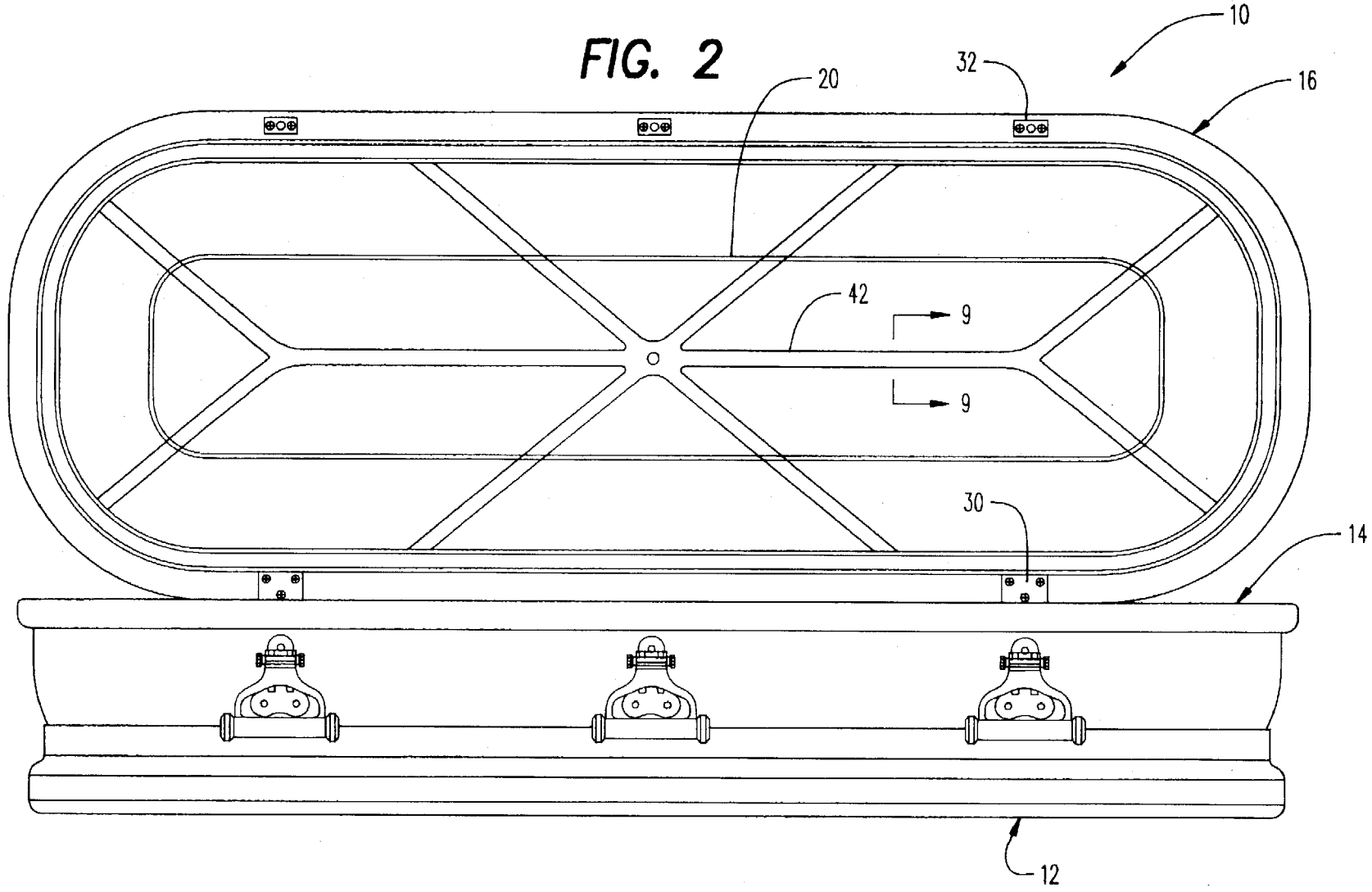
FIG. 2 is a side elevation view of the invention with the lid in its open position.
Figures 3, 4, 5A, 5B:
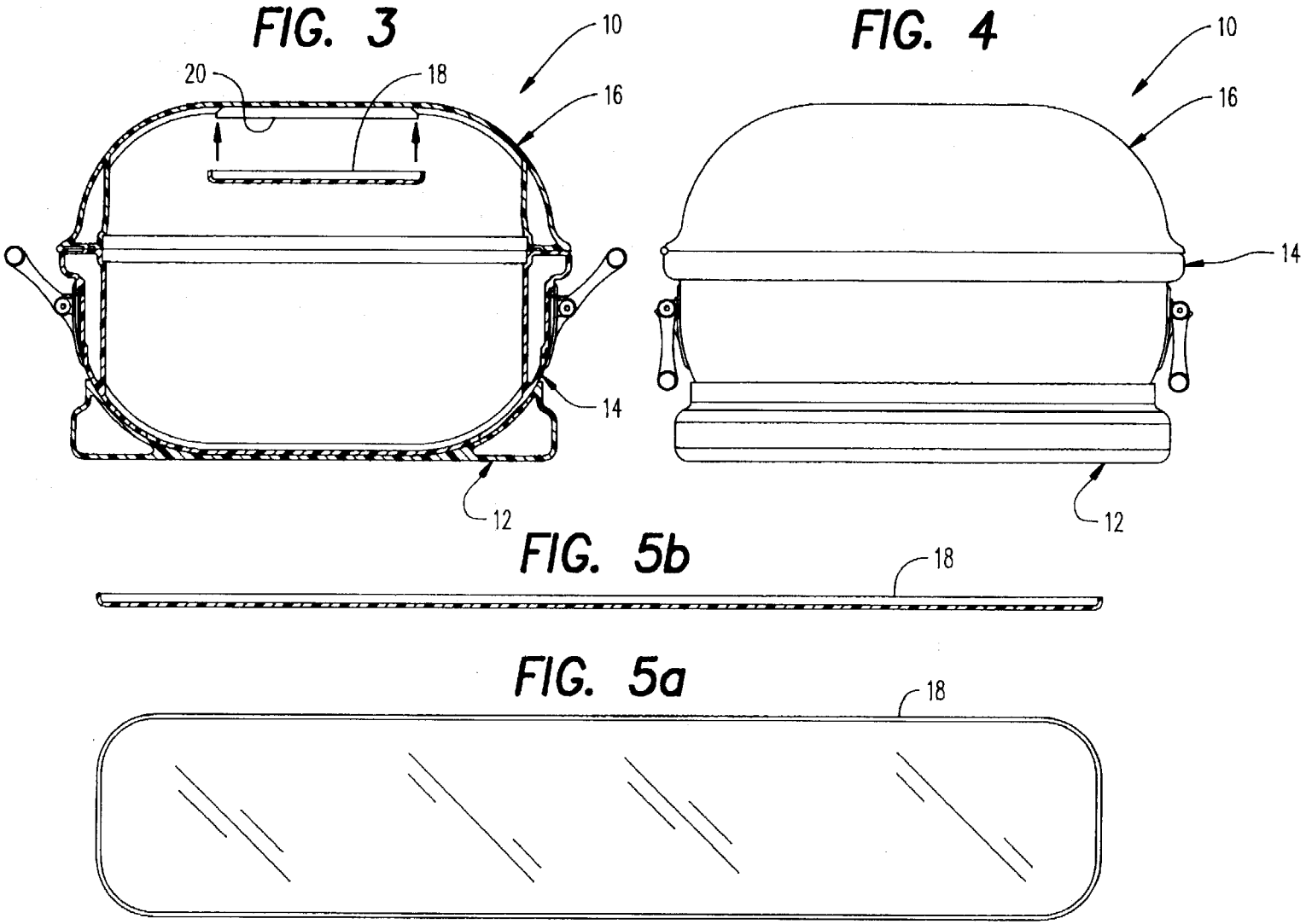
FIG. 3 is an end section view of FIG. 2 with the lid in the closed position.
FIG. 4 is an end view of FIG. 2 with the lid in a closed position.
FIG. 5*a* is a side elevation view of a fabric head panel for the lid which is shown in plan view in FIG. 5*b*.
FIG. 5*b* a plan view of a fabric head panel for the lid.

Referring now to the drawings, and particularly to FIGS. 1 to 4, the invention is shown generally at numeral 10 and includes a molded plastic pedestal base 12, a molded plastic tub 14 and a molded plastic lid 16. When interconnected as in the exploded arrangement shown in FIG. 1, these individual, integrally molded components form the casket 10.

Figure 6:
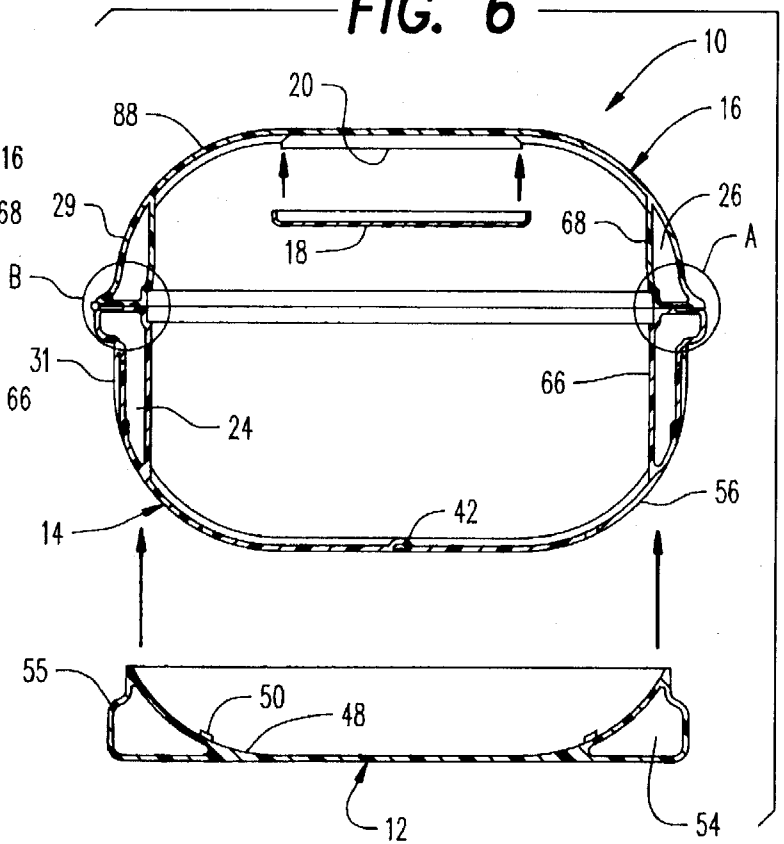
FIG. 6 is an exploded end section view of FIG. 3.

As seen additionally in FIG. 6, the tub 14 has an outer surface 56 and corresponding inner surface which are essentially continuously curvilinear in that there are no significant non-curved surfaces. This outer surface 56 mateably engages with the upper surface 48 of pedestal base 12. Likewise, the lid 16 has an upper surface 88 which is continuously curved in substantially all areas for economy of manufacture and consistency of flow of molten plastic material into all areas.

Each of these separate components 12, 14 and 16 are injection molded as separate units in substantially a single operation. The plastic injection molding operation includes the injection of either gas or more broadly a fluid during the molding process to produce strengthening and weight reduction cavities or hollow portions at 26 in lid 16, at 24 in tub 14 and at 54 in pedestal base 12. These hollow portions 26, 24, and 54 forming the side perimeters 29, 31 and 55, respectively of each of these members are generally continuous and are formed in accordance with one or more of the teachings of the prior patents described in the Background hereinabove. Hollow cavities 26 and 24 also terminate at mating or sealing distal surfaces 27 and 25, respectively.

Figure 20:
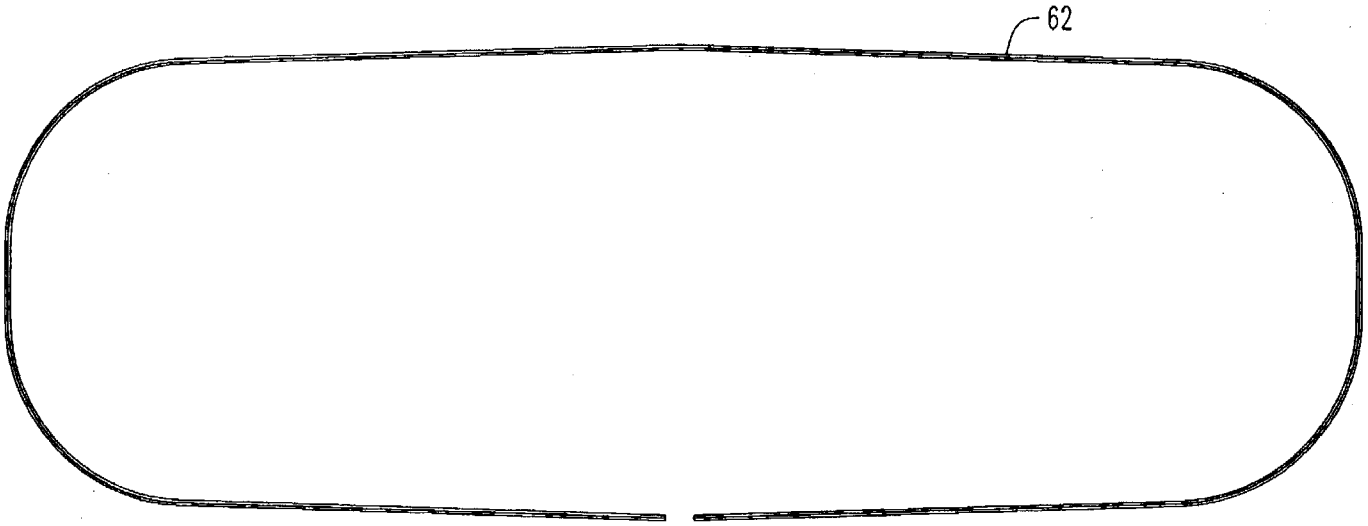
FIG. 20 is a plan view of the liner holder spring ring.

The molded lid 16 includes in its structural design and automatically molded at manufacture a cavity 20 centrally positioned in the lower surface thereof for receiving a separately fabricated plastic liner 18 for decorative enhancement as desired. Additionally, as seen in FIGS. 7 and 8, a molded cavity, shown generally at 52, formed by the cooperative mating continuous recessed structure of the inner perimeter of the lid 16 and tub 14, lockingly receives retaining rings 62 and 64 as seen in FIG. 20 which extend generally continuously around the entire inner perimeter of cavity 52 so as to retain flexible fabric material applied atop surfaces 66 and 68 of the lid 16 and tub 14, respectively.

In addition to the hollow structural perimeters 24, 26 and 54 described hereinabove, fluid injection techniques are also utilized to form stiffening rib 42 having hollow 44 as shown typically in FIG. 9. These stiffening ribs 42 (typ.) extend strategically over the lower or interior surface of the lid 16 and the upper interior surface of tub 12 as shown typically in FIG. 2.

Figure 7:
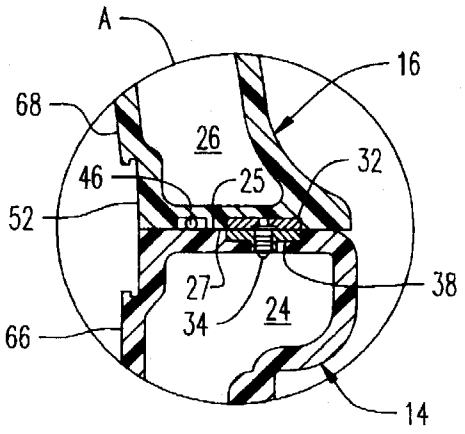
FIG. 7 is an enlarged section view of area A in FIG. 6.
Figure 8:
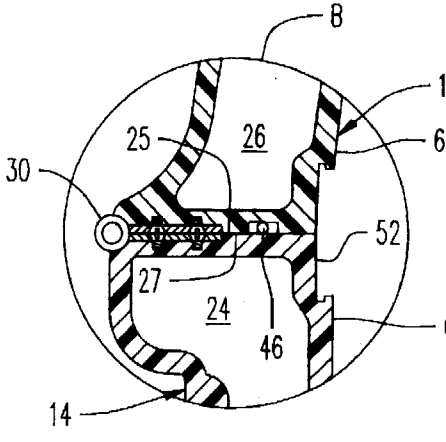
FIG. 8 is an exploded section view of area B in FIG. 6.

The lid 16 is pivotally connected to the tub 14 about a common peripheral margin by hinges 30 shown best in FIG. 8. Along the opposite longitudinal mating margin shown in FIG. 7, a permanent, automatically engagable latch arrangement is there shown. A support plate 32 is threadably engaged with latch 34 and connected by fasteners into the mating surface cavity of lid 16, while a latch receiver 38 is suitably connected by threaded fasteners to the corresponding aligned opposing surface of the perimeter of tub 14. By this arrangement, the serrated outer surface of latch 34 engages through slotted receiving hole 40 in a one-time operation to lockably engage these two members together and to permanently close the lid 16 onto the tub 14.

A neoprene O-ring 46 extends continuously around the mating perimeter surfaces of the lid and tub as seen in FIGS. 7 and 8 so as to hermetically seal the interior contents of the casket 10 after it has been sealed closed and interred. Thus, the contents as they decay will not pass into the adjacent ground and ground water and, likewise, the plastic structure of the casket itself 10 will virtually never deteriorate so as to have any impact whatsoever on the ground or water environment associated with interment of the invention 10 and its contents.

Referring additionally to FIG. 13, the tub 14 mateably engages at cavities 58 with protrusions 50 molded into the upper surface 48 of pedestal 12. A threaded fastener 60 permanently secures this self-aligned connection so that the pedestal 12 becomes a permanently connected structural support feature for the tub 14.

Removable handles are also provided as seen best in FIGS. 11, 12, and 16 to 18 for carrying the casket 10 and removal at interment. A plurality of evenly spaced receiving cavities 22 are molded into the outer side surfaces of tub 14 as shown in hidden lines in FIG. 1. Each of these molded cavities 22 includes an upright portion **72*a* and a lower horizontal portion 74*a* which mateably and supportively engage with portions 72 and 74 of a handle mounting bracket 70 as best seen in FIGS. 16 and 17. Surface 75 of mounting bracket 70 mateably engages against the corresponding outer surface of the tub 12 for additional support. However, the flange structure of portions 72 and 74 which mateably engage into the receiving cavity 22** provide the majority of the strength of this interconnection.

Figure 19:
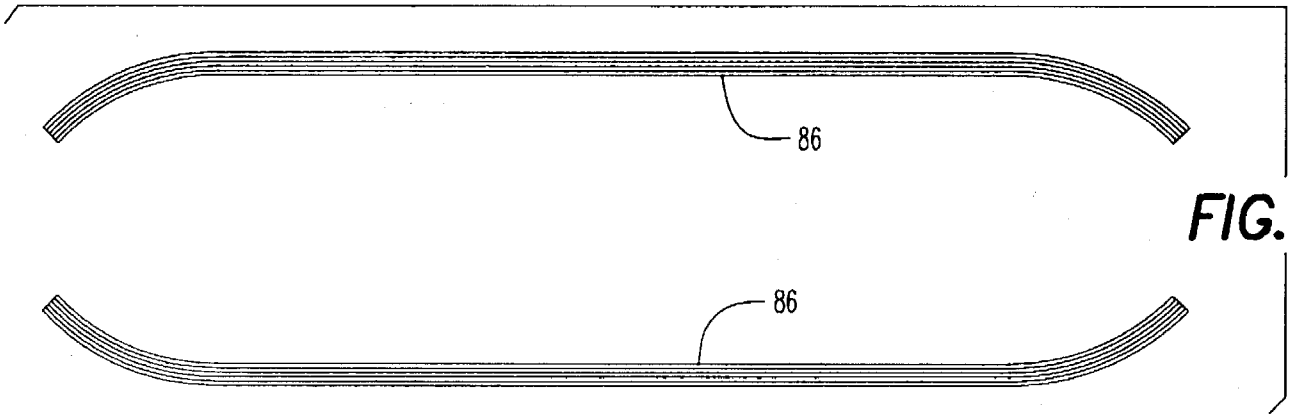
FIG. 19 is a plan view of two casket carrying handles.

The handle mounting bracket 70 also includes spaced mounting ears 76 having a longitudinal bore therethrough which engage with mounting boss 78 of carrying handle 76 shown in FIGS. 11 and 12. A suitable bolt or pin (not shown) passing through the common aligned holes secures the carrying handle 76 in place with respect to the mounting bracket 70. Optionally, each carrying handle 76 may include a longitudinal bore 82 in the handle portion 80 so that an elongated casket carrying rod or pole 86 in FIG. 19, may pass through each set of handles 76 on each side of the casket for pall bearer convenience.

In general, the molded plastic material which may be utilized to form each of the individual units of the casket 10 may be chosen from virtually any thermalplastic material which may be injection molded, including recycled plastic. Thus, the present invention affords a casket which is extremely strong and light weight, yet is economically moldable and, when interred, will last virtually indefinitely while sealing all body fluids and other decaying material therewith so as not to affect the surrounding ground and water aquifer. Because the majority of the structural features of the present invention have been incorporated into the three major components of tub, lid and pedestal base, economy of assembly is also achieved.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A casket comprising:

a unitary tub molded of plastic as a single unit having an endless or continuous hollow strengthening portion which extends circumferencially entirely around substantially all of a side perimeter of said tub and extending from a distal sealing surface of said tub toward, but not to a central portion of said tub, said tub having substantially continuously curved inner and outer surfaces;

a unitary pedestal base molded of plastic as a single unit having an endless or continuous hollow strengthening portion which extends circumferencially entirely around substantially all of a side perimeter of said base from a distal perimeter margin of said base toward, but not to, a central portion of said base, said base having a curved upper molded surface which supportively engages with a continuously curved bottom surface of said tub;

alignment and locking means for properly aligning and connecting said tub within said pedestal base;

a unitary lid integrally molded of plastic as a single unit having an endless or continuous hollow strengthening portion which extends circumferencially entirely around substantially all of a side perimeter of said lid and extending from a distal sealing surface of said lid toward, but not to, a central portion of said lid, said lid having continuous curved upper and lower surfaces;

hinge means for pivotally connecting said tub and said lid together along one common mating longitudinal side portion of each said sealing surface.

2. A casket as set forth in claim 1, further comprising:

sealing means between said sealing surfaces for hermetically sealing the interior of said casket when closed.

3. A casket as set forth in claim 2, further comprising:

locking means for permanently self locking said tub and said lid together when closed.

4. A casket as set forth in claim 3, further comprising:

a decorative fabric head liner connected onto and covering a main central portion of the lower surface of said lid.

5. A casket as set forth in claim 4, further comprising:

removable handle means for carrying said casket.

6. A casket as set forth in claim 5, wherein said tub and said lid further comprise:

reinforcing sealed hollow ribs formed into said tub upper surface and said lid lower surface.

7. A casket, each component of which is separately molded as a single one-piece plastic product produced by selective fluid injection into molten plastic comprising:

a tub having an endless or continuous sealed hollow peripheral side portion extending substantially entirely around a distal perimeter of said tub and terminating at a distal sealing surface thereof, said tub having continuous curved inner and outer surfaces and a substantially non-hollow central portion;

a pedestal base having an endless or continuous hollow side portion substantially extending entirely around a distal perimeter of said base and terminating at a distal sealing surface thereof, said base having a curved upper molded surface which supportively engages with a curved bottom surface of said tub and a substantially non-hollow central portion;

alignment and locking means for properly aligning and connecting said tub within said pedestal base;

a lid having an endless or continuous hollow peripheral side portion extending substantially a distal perimeter of said lid and terminating at a distal sealing surface of said tub, said lid having curved upper and lower surfaces and a substantially non-hollow central portion;

hinge means for pivotally connecting said tub and said lid together along common mating longitudinal portions of said sealing surfaces.

8. A casket as set forth in claim 7, further comprising:

sealing means between said sealing surfaces for hermetically sealing mating surfaces between said lid and said tub when said casket is closed.

9. A casket as set forth in claim 8, further comprising:

locking means for permanently self locking said tub and said lid together when closed.

10. In a casket comprising a plastic tub having inner and outer surfaces, a plastic lid having upper and lower surfaces and hinge means for pivotally connecting said tub and said lid together along a common longitudinal portion of mating circumferencial sealing surfaces of said tub and said lid, and a pedestal base having a curved upper molded surface which supportively engages with a curved bottom surface of said tub, the improvement comprising;

an endless or continuous closed hollow side portion extending circumferencially substantially entirely around a horizontal distal perimeter portion of each separate said tub, said lid and said base, a central portion of said lid, said tub and said base being substantially solid or non-hollow.

11. A casket as set forth in claim 10, further comprising:

alignment and locking means for properly aligning and connecting said tub within said pedestal base.

12. A casket as set forth in claim 11, further comprising:

sealing means between said sealing surfaces of said lid and said tub for hermetically sealing the interior of said casket when closed.

13. A casket as set forth in claim 12, further comprising:

self-locking means for permanently self locking said tub and said lid together when closed.

* * * * *